US009587847B2

(12) United States Patent
Vogel et al.

(10) Patent No.: US 9,587,847 B2
(45) Date of Patent: Mar. 7, 2017

(54) STAGING CLIMATE CONTROL SYSTEM CONTROLLER FUNCTIONS BASED ON AVAILABLE POWER

(71) Applicant: Emerson Electric Co., St. Louis, MO (US)

(72) Inventors: G. Scott Vogel, Fenton, MO (US); Rishi Siravuri, Maryland Heights, MO (US)

(73) Assignee: Emerson Electric Co., St. Louis, MO (US)

( * ) Notice: Subject to any disclaimer, the term of this patent is extended or adjusted under 35 U.S.C. 154(b) by 268 days.

(21) Appl. No.: 14/634,283

(22) Filed: Feb. 27, 2015

(65) Prior Publication Data

US 2016/0252264 A1 Sep. 1, 2016

(51) Int. Cl.
*F24F 11/00* (2006.01)
*F24F 11/02* (2006.01)

(52) U.S. Cl.
CPC ..... *F24F 11/001* (2013.01); *F24F 11/006* (2013.01); *F24F 11/02* (2013.01); *F24F 2011/0047* (2013.01); *F24F 2011/0068* (2013.01); *F24F 2011/0075* (2013.01)

(58) Field of Classification Search
CPC ..... H04L 69/22
USPC ..... 307/140, 150
See application file for complete search history.

(56) References Cited

U.S. PATENT DOCUMENTS

| | | | |
|---|---|---|---|
| 7,397,369 | B2 | 7/2008 | Zajac et al. |
| 7,696,870 | B2 | 4/2010 | Zajac et al. |
| 8,421,621 | B2 | 4/2013 | Zajac et al. |
| 8,511,576 | B2 | 8/2013 | Warren et al. |
| 8,511,577 | B2 | 8/2013 | Warren et al. |
| 8,627,127 | B2 | 1/2014 | Mucignat et al. |
| 8,770,491 | B2 | 7/2014 | Warren et al. |
| 2012/0179300 | A1 | 7/2012 | Warren et al. |

OTHER PUBLICATIONS

*FTC Sensors, LLC* v. *Emerson Electric Co.* Complaint, Eastern District of Texas, Case 2:15-cv-02012 filed Nov. 30, 2015; 11 pages.

*Primary Examiner* — Robert Deberadinis
(74) *Attorney, Agent, or Firm* — Harness, Dickey & Pierce, P.L.C.

(57) ABSTRACT

Disclosed are exemplary embodiments of climate control system controllers and methods for staging controller functions. In an exemplary embodiment, a climate control system controller generally includes power stealing circuitry, charge storage device(s) for storing charge provided by the power stealing circuitry and for providing power for controller functions, and a processor. For each controller function, the processor predefines a maximum wait time corresponding to the controller function. Before performance of one of the controller functions, the processor compares at least once the current level of charge on the charge storage device(s) to a predefined voltage level. Based on the comparing, the processor delays performance of the controller function until the corresponding predefined maximum wait time has passed and/or the current level of charge on the charge storage device(s) has reached the predefined voltage level.

20 Claims, 2 Drawing Sheets

STAGING CLIMATE CONTROL SYSTEM CONTROLLER FUNCTIONS BASED ON AVAILABLE POWER

FIELD

Figure 1:
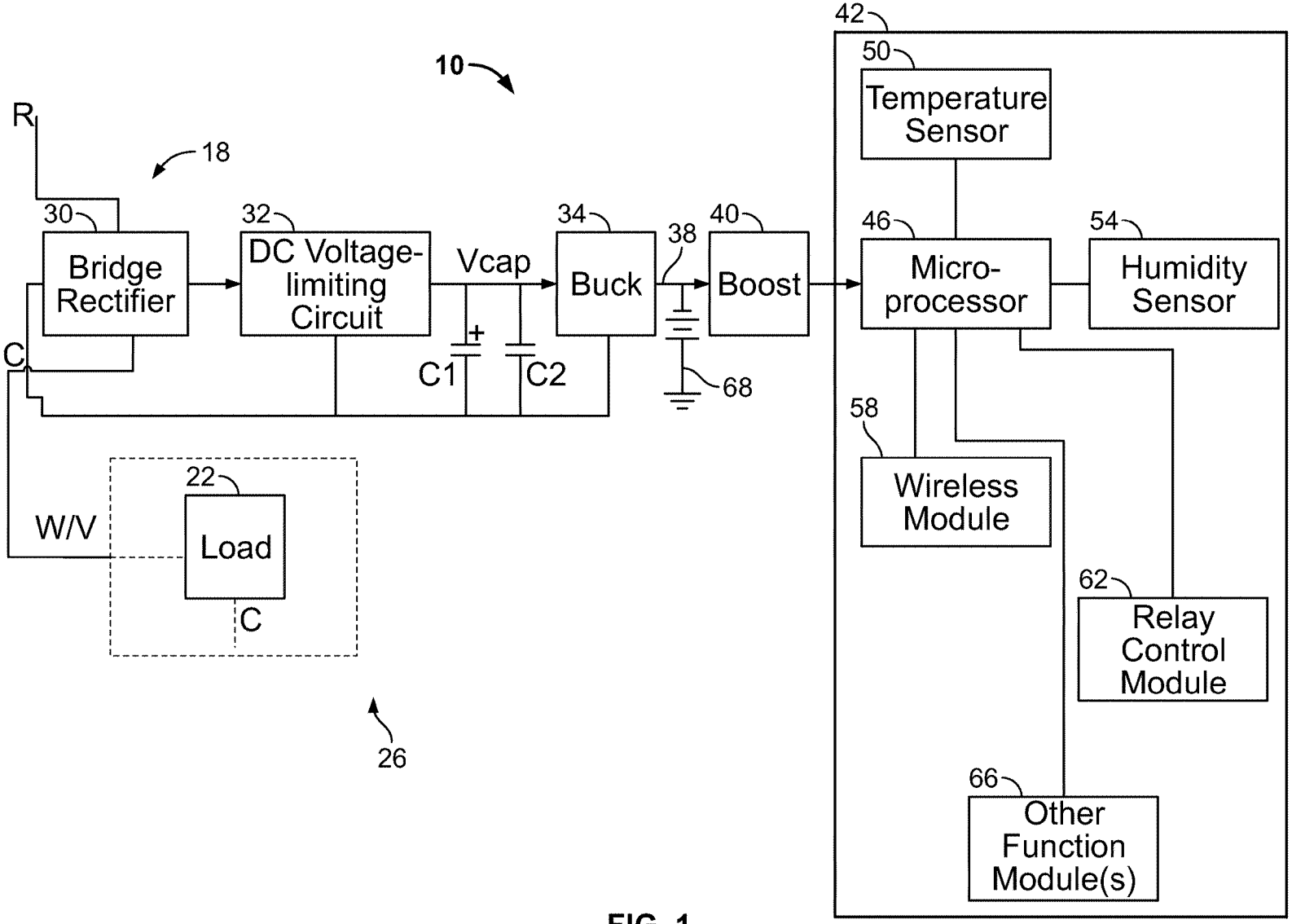

The present disclosure generally relates to climate control system controllers such as thermostats, and more particularly (but not exclusively) to staging wireless controller functions based on available power.

BACKGROUND

This section provides background information related to the present disclosure which is not necessarily prior art.

Digital thermostats and other climate control system controllers typically have microcomputers and other components that continuously use electrical power. Various thermostats may utilize power stealing to obtain operating power. Thus, for example, when a load (e.g., a compressor, fan, or gas valve) in a climate control system has been switched off, operating power for the thermostat may be stolen from the circuit for that load.

SUMMARY

This section provides a general summary of the disclosure, and is not a comprehensive disclosure of its full scope or all of its features.

According to various aspects, exemplary embodiments are disclosed of climate control system controllers and methods for staging controller functions. In an exemplary embodiment, a controller of a climate control system generally includes power stealing circuitry, one or more charge storage device for storing charge provided by the power stealing circuitry and for providing power for performance of functions of the controller, and a processor. The processor is configured to, for each of the controller functions, predefine a maximum wait time corresponding to the controller function. Before performance of a given one of the controller functions, the processor compares at least once the current level of charge on the charge storage device(s) to a predefined voltage level. Based on the comparing, the processor delays performance of the given controller function until the corresponding predefined maximum wait time has passed and/or the current level of charge on the charge storage device(s) has reached the predefined voltage level.

In another exemplary embodiment, a thermostat generally includes a wireless module for providing wireless communication by the thermostat. The thermostat also includes power stealing circuitry and one or more charge storage device for storing charge to provide power from the power stealing circuitry for performance of a plurality of thermostat functions. A processor of the thermostat is configured to, for each of at least a plurality of functions of the wireless module, predefine a maximum wait time corresponding to the wireless module function. Before performance of one of the wireless functions, the processor compares at least once the current level of charge on the charge storage device(s) with a predefined voltage level. Based on the current level of charge, the processor delays performance of the wireless function until one or more of the following occurs: the predefined maximum wait time corresponding to the wireless function has expired, and the current level of charge has reached the predefined voltage level.

Also disclosed are various implementations of methods. A thermostat-performed method generally includes, for each of a plurality of functions to be performed by the thermostat, predefining a maximum wait time corresponding to the function. The thermostat monitors one or more charge storage device that receives power from power stealing circuitry of the thermostat and that provides power for performance of the thermostat functions. Before performing a given one of the thermostat functions, the thermostat evaluates at least once the current level of charge on the charge storage device(s), and based on the evaluating, waits before performing the given one of the thermostat functions. The waiting is performed until occurrence of one or more of the following: the corresponding predefined maximum wait time has passed, and the current level of charge on the charge storage device(s) has reached a predefined voltage level.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 2:
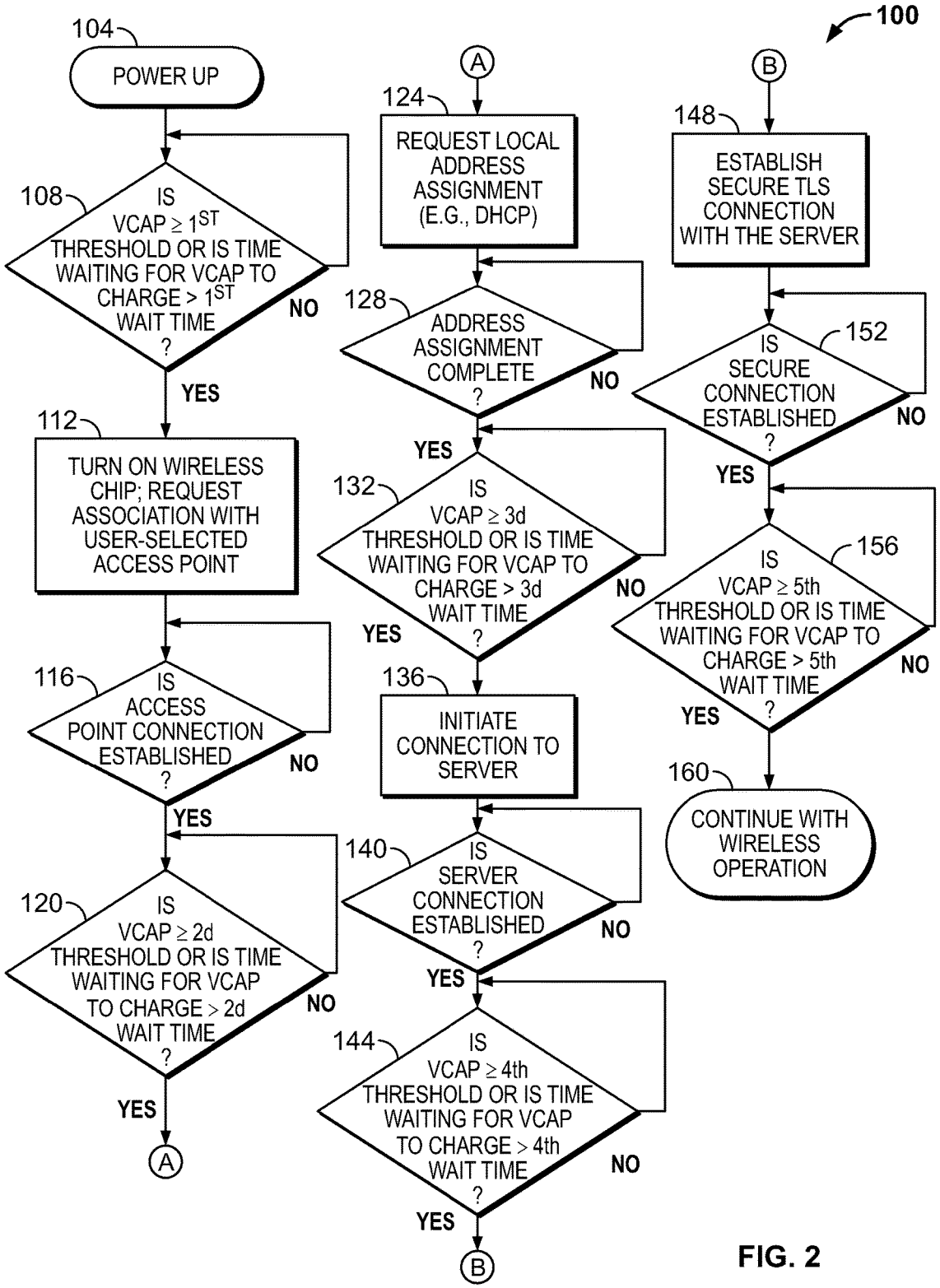

FIG. 1 is a diagram of an exemplary embodiment of a climate control system controller in accordance with one or more aspects of the present disclosure; and FIG. 2 is a flow diagram of an exemplary embodiment of a method of staging wireless radio functions in accordance with one or more aspects of the present disclosure.

Corresponding reference numerals indicate corresponding parts throughout the several views of the drawings.

DETAILED DESCRIPTION

Example embodiments will now be described more fully with reference to the accompanying drawings.

The inventor hereof has recognized that a power stealing thermostat is an example of a device that relies on a limited amount of instantaneous power to store a charge, e.g., on a capacitor or other charge storage medium, for subsequent use by the device. The charge increases when the power-stealing charge rate exceeds the instantaneous power demand by the device, and decreases when demand exceeds the power-stealing charge rate. If the demand exceeds the charge rate frequently enough, the charge can drop to a point, e.g., where battery power is used to satisfy the excess demand.

When, e.g., the wireless radio of a thermostat is disabled, power stealing may provide more power than is being consumed, so the charge increases and no battery power is required. However, when the wireless radio powers up, there can be substantial power demand until the wireless radio module initializes and receives a command, e.g., to operate in a low-power mode. Once the radio has been powered up, a considerable number of wireless radio message transactions typically are executed to connect the radio, e.g., to a wireless access point and then to a server. Many of the same transactions typically are repeated every time the radio gets disconnected from the access point and/or server.

Accordingly, the inventors have developed and disclose herein exemplary embodiments of climate control system controllers and methods for staging controller functions. In various embodiments, delays may be incorporated, e.g., between successive wireless functions such as power-up, server-connect, and/or other processes, e.g., to separate in time the performances of functions for which demand for charge from a charge storage device, e.g., a capacitor, is estimated to exceed the charge rate of the charge storage device. The charge storage device may be recharging during a delay. A delay may be active, e.g., only if it is determined that the current level of stored charge is below a predetermined threshold voltage. In various embodiments, so that controller operation is not unduly inhibited, delays are provided with a timeout such that, e.g., if a threshold amount of stored charge is not reached, a given function is performed after the delay has timed out.

In various embodiments, delays are configured to allow at least some charge to be recovered on the charge storage device, e.g., between performances of high-charge-demand functions. Thus, for example, delays may be added so that after power-up, a controller (a) waits for sufficient charge before turning on Wi-Fi or other wireless capability, (b) waits for sufficient charge before connecting to an access point, (c) waits for sufficient charge before initiating a protocol for obtaining a local address assignment, (d) waits for sufficient charge before requesting connection to a server, (e) waits for sufficient charge before establishing a secure transport layer security (TLS) connection, and so on, during wireless communication.

With reference now to the figures, FIG. 1 illustrates an exemplary embodiment of a climate control system controller, e.g., a thermostat 10 embodying one or more aspects of the present disclosure. As shown in FIG. 1, power stealing circuitry 18 of the thermostat 10 obtains power, e.g., through one or more loads 22 of a climate control system 26 in which the thermostat 10 is included. For example, as shown in FIG. 1, a bridge rectifier 30 of the power stealing circuitry 18 receives power, e.g., at between 18 VAC and 30 VAC, through a heating or cooling load 22 that is deactivated. The deactivated load 22 may be e.g., a gas valve or compressor that is switched off. The power stealing circuitry obtains power through the load 22 from, e.g., a transformer (not shown) that powers the load 22 when the load 22 is switched on.

It should be noted that the power stealing circuitry 18 is only exemplary. In various embodiments of the disclosure, power stealing may be performed in various ways, for various amounts of power, and from various power sources, activated loads, etc. It should be noted further that embodiments could be implemented in accordance with aspects of the present disclosure in relation to other or additional electronic devices and/or controllers besides thermostats. Still further, although various voltages, component values, and other values are provided in various example embodiments described herein, such values are examples only and are provided to facilitate understanding of the various embodiments.

Referring again to FIG. 1, the bridge rectifier 30 may provide a wide range of DC output voltage, e.g., from about 25V to about 42V, to a DC voltage-limiting circuit 32. The DC voltage-limiting circuit 32 charges two power supply capacitors C1 and C2, e.g., each to about 30 VDC. In various embodiments, the voltage-limiting circuit 32 may charge the capacitors C1 and C2 at controlled rates, e.g., in order to prevent overheating and over-voltage conditions in the power stealing circuitry 18. A voltage step-down converter, e.g., a buck circuit 34, is connected with the DC voltage-limiting circuit 32 and across the capacitors C1 and C2, which provide power to the buck circuit 34.

The buck circuit 34 provides a voltage output 38 of, e.g., 3.3 VDC to a boost circuit 40, which in the present example embodiment is the primary power supply circuit for the thermostat 10. The boost circuit 40 provides power to various thermostat circuits 42, which may include, for example, a microprocessor 46, temperature and humidity sensors 50 and 54, a wireless radio module 58, a relay control module 62, and/or module(s) 66 for other thermostat function(s). In the present example embodiment, the boost circuit 40 provides power to at least the wireless radio module 58, by which the thermostat 10 may wirelessly communicate, e.g., with a wireless network (not shown) in a home or other structure in which the thermostat 10 is installed. The wireless radio module 58 includes a transmitter, receiver and processor (not shown). One or more batteries 68 are provided as a supplemental power source for the thermostat 10.

The boost circuit 40 supplies additional current, e.g., in milliamps, for operating the wireless radio module 58, thus "boosting" available power when the wireless radio module 58 is operating. The level of voltage Vcap that may be available at the capacitors C1 and C2 varies in accordance with amounts of power provided to the thermostat 10 through the buck circuit 34 and amounts of charge received from the power stealing circuitry 18.

In the present example embodiment, when the voltage Vcap on the capacitors C1 and C2 feeding the buck circuit 34 falls to a level referred to in this disclosure as the "shut-off" voltage level, e.g., 6.3 VDC, the buck circuit 34 shuts down, thereby terminating the voltage output 38 to the boost circuit 40. In the present embodiment, when the boost circuit 40 does not receive power from the buck circuit 34, the boost circuit 40 receives all of its power from the battery(s) 68. When the buck circuit 34 is off, the capacitors C1 and C2 may be recharged through the power stealing circuitry 18 as previously described. In the present example embodiment, when the voltage Vcap on the capacitors C1 and C2 increases and exceeds a level referred to in this disclosure as the "buck/boost" voltage level, e.g., 15 VDC, the buck circuit 34 is switched on and the boost circuit 40 receives power from the buck circuit 34.

When the voltage Vcap is between the shut-off voltage level and the buck/boost voltage level, the capacitors C1 and C2 may alternate with the battery(s) 68 to provide power for thermostat functions. For example, as the capacitors C1 and C2 discharge and the voltage Vcap decreases from the buck/boost voltage level down to the shut-off voltage level, the capacitors C1 and C2 may provide all power for thermostat functions. As the capacitors C1 and C2 are recharged and the voltage Vcap increases from the shut-off voltage level to the buck/boost voltage level, the battery(s) 68 may provide all power for thermostat functions.

As the voltage Vcap is increased to above the buck/boost voltage level, the capacitors C1 and C2 may provide all power for thermostat functions, without supplemental power from the battery(s) 68. Thus it is desirable to maintain the voltage Vcap above the buck/boost voltage level, so that draw from the battery(s) 68 may be minimized and power to the thermostat 10 can be obtained as much as possible through the power stealing circuitry 18. Accordingly, in one example embodiment, a threshold voltage level, e.g., 25 VDC, is predefined between the buck/boost voltage level and the maximum charge level of the capacitors C1 and C2. The voltage Vcap may be kept above the buck/boost voltage level, e.g., by recharging Vcap to the threshold voltage level between performances of successive thermostat functions as further described below.

In one example implementation, the microprocessor 46 monitors the voltage Vcap and stages successive functions to be performed, e.g., by the wireless radio module 58, based at least in part on available power. Unless otherwise indicated in the present disclosure and claims, "staging" two successive functions refers to predefining a conditional maximum wait time between the two functions, and providing timing for the subsequent function such that the length of an actual wait time (if any) between the two functions would depend at least in part on a current level of available voltage but would not exceed the maximum wait time.

One example method of staging wireless radio functions, e.g., to minimize power draw is referred to generally in FIG. 2 by reference number 100. In process 104, the wireless radio module 58 is powered up, e.g., from power obtained from the capacitors C1 and C2 through the buck and boost systems 34 and 40. In process 108 it is determined whether at least one of two conditions has been satisfied: (1) whether the voltage Vcap is greater than or equal to a first threshold voltage, e.g., 25 VDC, or (2) whether a time period for waiting for the voltage Vcap to charge to the first threshold voltage has exceeded a first predetermined wait time, e.g., 30 seconds. If neither of the conditions has been satisfied, a delay continues until the first predetermined wait time has passed or the voltage Vcap has been charged to the first threshold voltage. Control then passes to process 112.

In process 112 a wireless chip of the wireless radio module 58 is switched on and requests to be associated with a wireless access point (not shown) selected by the user of the thermostat. The wireless access point may be, e.g., a router/access point of the user's home network. In process 116 the wireless radio module 58 waits until an access point connection has been established between the wireless radio module 58 and the user-selected access point.

When a connection has been established between the wireless radio module 58 and the access point, then in process 120 it is determined whether at least one of two conditions has been satisfied: (1) whether the voltage Vcap is greater than or equal to a second threshold voltage, e.g., 25 VDC, or (2) whether a time period for waiting for the voltage Vcap to charge to the second threshold voltage has exceeded a second predetermined wait time, e.g., 30 seconds. If neither of the conditions has been satisfied, a delay continues until the second predetermined wait time has passed or the voltage Vcap has been charged to the second threshold voltage. Control then passes to process 124.

In process 124 the wireless radio module 58 requests that a local IP address be assigned to the wireless radio module 58 by a network server, e.g., in accordance with the dynamic host configuration protocol (DHCP) or some other dynamic or static procedure. As known in the art, various network protocols such as DHCP can involve a number of communications back and forth between a server and a potential client of the server. In process 128 the wireless radio module 58 waits until a local IP address has been assigned to the wireless radio module 58 by a network server and the address assignment has been completed.

In a process 132 it is determined whether at least one of two conditions has been satisfied: (1) whether the voltage Vcap is greater than or equal to a third threshold voltage, e.g., 25 VDC, or (2) whether a time period for waiting for the voltage Vcap to charge to the third threshold voltage has exceeded a third predetermined wait time, e.g., 30 seconds. If neither of the conditions has been satisfied, a delay continues until the third predetermined wait time has passed or the voltage Vcap has been charged to the third threshold voltage. Control then passes to process 136.

In a process 136 a connection to the server is initiated. After it has been determined in process 140 that the server connection has been established, then in process 144 it is determined whether at least one of two conditions has been satisfied: (1) whether the voltage Vcap is greater than or equal to a fourth threshold voltage, e.g., 25 VDC, or (2) whether a time period for waiting for the voltage Vcap to charge to the fourth threshold voltage has exceeded a fourth predetermined wait time, e.g., 30 seconds. If neither of the conditions has been satisfied, a delay continues until the fourth predetermined wait time has passed or the voltage Vcap has been charged to the fourth threshold voltage. A secure transport layer security (TLS) connection with the server then is established in process 148. When in process 152 it has been determined that the secure connection has been established, then in process 156 it is determined whether at least one of two conditions has been satisfied: (1) whether the voltage Vcap is greater than or equal to a fifth threshold voltage, e.g., 25 VDC, or (2) whether a time period for waiting for the voltage Vcap to charge to the fifth threshold voltage has exceeded a fifth predetermined wait time, e.g., 30 seconds. If neither of the conditions has been satisfied, a delay continues until the fifth predetermined wait time has passed or the voltage Vcap has been charged to the fifth threshold voltage. Thereafter, wireless operation is continued in process 160.

It should be noted that various wait times and various charge threshold voltages for Vcap could be predefined in relation to staging the performance of various processes, dependent, e.g., on how much power is projected to be used, e.g., by the wireless radio module 58 in performing a given process, and how much time is projected to be an appropriate recharging time to obtain at least some of the projected power. Thus, although a single wait time of 30 seconds and a single voltage threshold value of 25 VDC are predefined for the wireless functions described in FIG. 3, a wait time and/or voltage threshold corresponding to one function could differ from a wait time and/or voltage threshold corresponding to another function based, e.g., on how much power a given function might use and/or how long it might take for the capacitors C1 and C2 to be charged to provide such power.

It also should be noted that the foregoing example method could be implemented when the wireless radio module 58 is in use at other or additional times, and not only in relation to provisioning of the wireless radio module 58 in a wireless network. Further, implementations in accordance with aspects of the disclosure are not limited to staging wireless functions, and various embodiments are possible in relation to other or additional functions of climate control system controllers. It also should be noted that methods of staging successive functions could be implemented in software, hardware, firmware, combinations of any of the foregoing, etc.

Implementations of the foregoing methods and controllers can reduce battery drain, for example, in a thermostat or other controller in which power-stealing circuitry limits how fast it can charge a charge storage device. Such implementations can be advantageous, e.g., in controllers and/or other devices in which the current needed, e.g., to power up and operate a wireless radio and connect and reconnect with a server exceeds the rate at which power stealing circuitry can provide charge.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances. Or, for example, the term "about" as used herein when modifying a quantity of an ingredient or reactant of the invention or employed refers to variation in the numerical quantity that can happen through typical measuring and handling procedures used, for example, when making concentrates or solutions in the real world through inadvertent error in these procedures; through differences in the manufacture, source, or purity of the ingredients employed to make the compositions or carry out the methods; and the like. The term "about" also encompasses amounts that differ due to different equilibrium conditions for a composition resulting from a particular initial mixture. Whether or not modified by the term "about," the claims include equivalents to the quantities.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A thermostat-performed method comprising:

for each of a plurality of functions to be performed by the thermostat, predefining a maximum wait time corresponding to the function;

monitoring one or more charge storage device that receives power from power stealing circuitry of the thermostat and that provides power for performance of the thermostat functions;

before performing a given one of the thermostat functions, evaluating at least once the current level of charge on the one or more charge storage device; and based on the evaluating, waiting before performing the given one of the thermostat functions, the waiting performed until occurrence of one or more of the following: the corresponding predefined maximum wait time has passed, and the current level of charge on the one or more charge storage device has reached a predefined first voltage level.

2. The method of claim 1, wherein the predefined maximum wait time for the given one of the thermostat functions corresponds to an estimated time in which to add charge to the one or more charge storage device.

3. The method of claim 1, wherein the given one of the thermostat functions is performed by a wireless module of the thermostat.

4. The method of claim 1, further comprising performing the given one of the thermostat functions when the evaluated current level of charge on the one or more charge storage device is greater than the predefined first voltage level.

5. The method of claim 1, further comprising:

for each of the thermostat functions, estimating an amount of charge for powering the function; and predefining the maximum wait time corresponding to the function based on the estimated amount.

6. The method of claim 5, further comprising:

based on the monitoring, delaying performance of a subsequent thermostat function after performance of the given one of the thermostat functions, until the predefined maximum wait time corresponding to the subsequent thermostat function has passed and/or the current level of charge on the one or more charge storage device has reached a predefined second voltage level.

7. The method of claim 1, further comprising using a battery to provide power for performing at least one of the thermostat functions while the one or more charge storage device is being charged.

8. The method of claim 1, performed to stage successive wireless functions of the thermostat.

9. A controller of a climate control system, the controller comprising:

power stealing circuitry;

one or more charge storage device for storing charge provided by the power stealing circuitry and for providing power for performance of functions of the controller; and a processor configured to:

for each of the controller functions, predefine a maximum wait time corresponding to the controller function;

before performance of a given one of the controller functions, compare at least once the current level of charge on the one or more charge storage device to a predefined first voltage level, and based on the comparing, delay performance by the controller of the given one of the controller functions until the corresponding predefined maximum wait time has passed and/or the current level of charge on the one or more charge storage device has reached the predefined first voltage level.

10. The controller of claim 9, wherein the predefined first voltage level is predefined based on an estimate of charge to be provided to power the given controller function without reducing the current level of charge on the one or more charge storage device to a level at which a battery is used to provide at least some power to the controller.

11. The controller of claim 9, wherein the processor is further configured to delay performance of a subsequent controller function after performance of the given one of the controller functions, until a predefined maximum wait time corresponding to the subsequent controller function has passed and/or the current level of charge on the one or more charge storage device has reached a predefined second voltage level.

12. The controller of claim 11, wherein the predefined first voltage level is equal to the predefined second voltage level.

13. The controller of claim 11, wherein the predefined maximum wait time corresponding to the subsequent controller function is equal to the predefined maximum wait time corresponding to the given one of the controller functions.

14. The controller of claim 9, comprising a thermostat.

15. The controller of claim 9, further comprising a wireless module whereby the controller is capable of wireless communication, the processor being configured to stage successive functions performable by the wireless module.

16. The controller of claim 9, wherein the one or more charge storage device comprises one or more capacitor.

17. A thermostat comprising:

a wireless module for providing wireless communication by the thermostat;

power stealing circuitry;

one or more charge storage device for storing charge to provide power from the power stealing circuitry for performance of a plurality of thermostat functions; and a processor configured to:

for each of at least a plurality of functions of the wireless module, predefine a maximum wait time corresponding to the wireless module function;

before performance of one of the wireless functions, compare at least once the current level of charge on the one or more charge storage device with a predefined voltage level; and based on the current level of charge, delay performance of the one of the wireless functions until one or more of the following occurs: the predefined maximum wait time corresponding to the one of the wireless functions has expired, and the current level of charge has reached the predefined voltage level.

18. The thermostat of claim 17, wherein the one of the wireless functions comprises one or more of the following: turning on a wireless chip, connecting to an access point, requesting an address assignment, requesting a connection with a server, and establishing a secure connection with a server.

19. The thermostat of claim 17, wherein the processor is configured to delay performance of the one of the wireless functions only when the current level of charge is less than the predefined voltage level.

20. The thermostat of claim 17, wherein the one or more charge storage device comprises one or more capacitor.

* * * * *